United States Patent [19]

Singer et al.

[11] Patent Number: 4,828,396

[45] Date of Patent: May 9, 1989

[54] FLUID PROCESSOR APPARATUS

[75] Inventors: Norman Singer, Highland Park; Jon Speckman, Lindenhurst; Bryan Weber, Deerfield, all of Ill.

[73] Assignee: The Nutrasweet Company, Deerfield, Ill.

[21] Appl. No.: 127,710

[22] Filed: Dec. 2, 1987

[51] Int. Cl.[4] ..... B01F 15/06; B01F 7/16

[52] U.S. Cl. ..... 366/149; 99/348; 99/453; 99/483; 366/75; 366/194; 366/314

[58] Field of Search ..... 366/64, 65, 97, 98, 366/197, 199, 205, 307, 279, 149, 314, 194, 342, 343; 99/348, 460, 453, 455; 62/342, 343

[56] References Cited

U.S. PATENT DOCUMENTS

| | | | |
|---|---|---|---|
| 2,826,401 | 3/1958 | Peters | 366/343 X |
| 3,250,519 | 5/1966 | Herfeld | 366/314 X |
| 3,333,831 | 8/1967 | Chapman | 366/343 X |
| 4,101,279 | 7/1978 | Aslam | 366/314 X |
| 4,147,437 | 4/1979 | Jonqueres | 366/343 |
| 4,260,267 | 4/1981 | Walton | 366/343 |
| 4,453,829 | 6/1984 | Althouse | 366/65 X |
| 4,664,530 | 5/1987 | Kurome et al. | 366/205 |

FOREIGN PATENT DOCUMENTS

| | | | |
|---|---|---|---|
| 563950 | 10/1932 | Fed. Rep. of Germany | 366/307 |

*Primary Examiner*—Timothy F. Simone

*Attorney, Agent, or Firm*—Marshall, O'Toole, Gerstein, Murray & Bicknell

[57] ABSTRACT

Batch and continuous fluid processing devices including means for generating toroidal flow in a fluid to be processed, disposed in a container whose internal surface conformation corresponds to and is substantially defined by the external surface of the fluid when it is undergoing toroidal flow. In preferred forms, processing apparatus includes a blade mounted for axial rotation within a vessel having bowl shaped interior. The vessel is provided with a lid whose interior surface is shaped to conform to the upper surface of a fluid undergoing toroidal flow.

19 Claims, 2 Drawing Sheets

FLUID PROCESSOR APPARATUS

FIELD AND BACKGROUND OF THE INVENTION

The present invention relates generally to fluid processing devices and more particularly to devices exceptionally well suited for batch and continuous processing of fluids, especially fluid food products.

The prior art includes a wide variety of devices designed for intimately mixing, emulsifying and/or homogenizing powders, granules and liquids. See, generally, U.S. Pat. Nos. 1,994,371, 2,436,767, 4,173,925, 4,395,133, 4,418,089 and 4,525,072. Typical of the mixing devices offered for commercial use are those commonly referred to as "Henschel" mixers manufactured by the Thyssen Henschel Company of West Germany. See, Generally, "Henschel Mixer, A Complete Survey", Brochure 1000E 8/83 BO, distributed by Purnell International, Houston, Tex. 77248. See also, U.S. Pat. Nos. 4,518,262, 4,176,966, 4,104,738 and 4,037,753. Henschel mixers generally include one or more rotating blades disposed at the base of a chamber and operative, if desired, to produce high shear forces in the material to be mixed as well as fluidizing effects on the material. A variety of Henschel mixer apparatus conformations are available which allow for cooling or heating of materials undergoing mixing.

Of interest to the background of the invention are continuous mixing devices such as those illustrated in U.S. Pat. Nos. 3,854,702 and 4,357,111 which have been designed to provide greater uniformity of temperature distribution within a material undergoing mixing. In brief, these devices include single and multiple mixing stages involving multiple mixing tools or blades and a variety of baffles operative to continuously reintroduce partially mixed materials into contact with the mixing tools.

Despite substantial research and development in the manufacture of devices for intimate mixing of materials, none of the designs extant in the art have adequately dealt with the problems of establishing of high degrees of uniformity of flow of materials within a mixing vessel so as to provide the desirable characteristic of uniformity of temperature distribution within the material (e.g., a fluid) undergoing mixing. A common undesirable characteristic of prior devices is the presence of multiple "dead zones" wherein the flow rate of fluids undergoing mixing is diminished (vis-a-vis the remainder of the fluid in the vessel) giving rise, e.g., to temperature differentials within the fluid. Attempts to solve such problems through introduction of scraper blades and baffles of various conformation have met with limited success because such components by definition interfere with the natural conformation of fluid flow which is imparted by the rotating blades and mixer tools, giving rise to eddies in the flow. Moreover, where fluids undergoing mixing are susceptible to physiochemical changes from liquid to solid forms at increased temperatures (e.g., proteins in solution undergoing heat denaturation and agglomeration) the presence of baffles and the like provides sites for collection and build-up of undesired product forms within the mixing vessel.

There thus continues to exist a need in the art for fluid processing apparatus of novel design which affords enhanced homogeneity in flow and temperature distribution within the material undergoing mixing treatment. Such apparatus would be especially useful in the food preparation arts wherein mechanical energy imparted by rotating blades and mixing tools gives rise to high shear forces and heat energy within proteinaceous fluids which may be susceptible to solidification, with consequent adverse effects on smoothness characteristics of end products.

BRIEF SUMMARY OF THE INVENTION

According to the present invention, batch and continuous fluid processing devices are provided which optimize homogeneity of flow and temperature distribution within a fluid undergoing mixing treatment. Most simply put, devices constructed according to the invention comprise mixing vessels whose interior surface conformation is shaped to match the external conformation of the fluid to be processed upon induction of fluid flow therein by suitable means such as a rotating blade.

In a presently preferred conformation, a processor according to the invention comprises a container housing having an enclosed substantially toroidally-shaped cavity or chamber within it and having disposed within the cavity a rotatable blade means for imparting a toroidal flow to a fluid to be processed. The housing of such devices ordinarily comprises a vessel and vessel lid, with the interior of the vessel having continuously curved walls forming a bowl shaped cavity and the lid having a recessed internal surface shaped to match the upper surface of a toroid. Ordinarily disposed at the base of bowl shaped cavity is a blade (having one, or, preferably, two or more blade arms) mounted for axial rotation closely adjacent the cavity lower surface, with the axis of rotation being aligned with the toroidal axis. Preferably, the arm or arms of the blade extend parallel to the axis of rotation and have a substantially bunt leading side which is forward in the direction of rotation.

Processors according to the invention may be designed for batch operation, with addition of starting material fluids and removal of final products being accomplished through removal or displacement of the vessel lid. Alternately, processors may be fitted for continuous operation by providing one or more fluid inlet and outlet ports, with the inlet port or ports disposed for fluid inlet flow between the blade and the adjacent cavity surface, and product outlet port or ports preferably disposed in the lid portion at or adjacent the toroidal axis. The processors may be suitably jacketed to add or remove heat from the container and its fluid contents and means may be provided for determining the temperature of the fluid within the processor.

During operation, the shear forces produced by the rotating blade simultaneously heat and mix the product in the cavity or chamber. During rotation of the blade, the product naturally assumes a toroidal configuration. Because the cavity is shaped to conform to the natural toroid, the presence of "dead zones" in the cavity during mixing is avoided as is the accumulation or buildup of product deposits within the cavity.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Figure 1A:
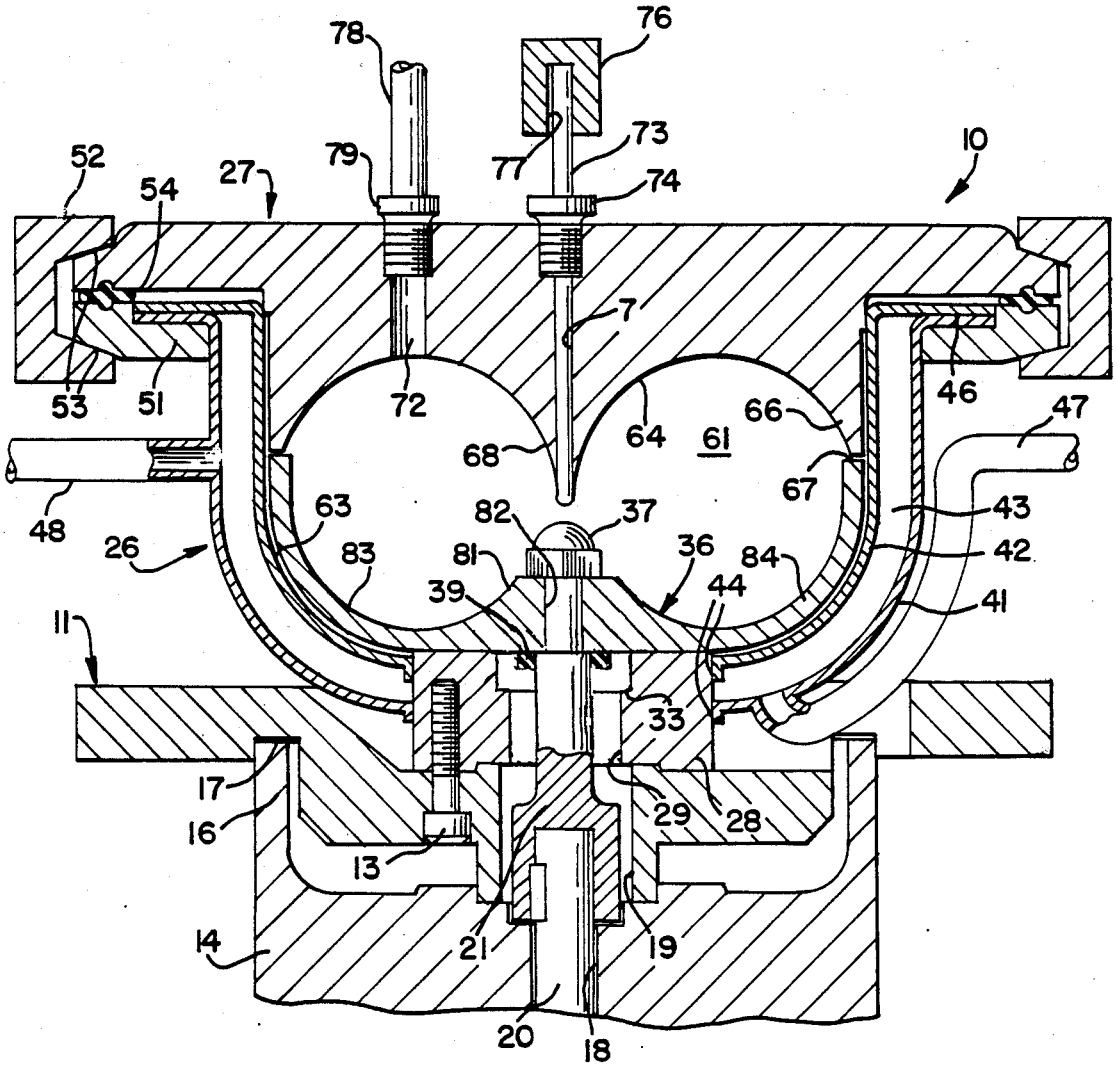
FIG. 1*a* is a sectional view showing an embodiment of the invention designed for batch operation.

While the following detailed description refers to the use of the apparatus in connection with processing a liquefied food product, it should be understood that the apparatus also has utility in processing other non-food items. Further, while the following detailed description may include references to locations of parts relative to other parts and other relative terms such as upper, lower, outer, inner, etc., it should be understood that these terms are used only to assist in the description of the apparatus and should not be considered as limiting the scope of the invention to the use of the apparatus in any particular orientation.

With reference first to FIG. 1, a processor constructed in accordance with this invention comprises a housing 10, which in this example is supported by a base plate 11 and secured to it by a plurality of bolts 13. The base plate 11 in turn is mounted on a stand 14 which has an annular rim 16 formed on its upper end. An annular recess 17 in the underside of the base plate 11 receives the rim 16. The stand 14 and the base plate 11 have aligned vertically extending passages 18 and 19 through them, and a vertically extending drive shaft 20 extends through the passage 18 and upwardly into the passage 19. The drive shaft 20 is connected to be rotated by a drive mechanism such as an electric motor (not illustrated) during operation of the processor. Secured to the upper end of the drive shaft 20 is a blade shaft 21, and a key coupling is provided between the two shafts 20 and 21.

The housing 10 of the processor comprises a lower vessel part 26 and an upper lid part 27, the vessel being supported on an annular bearing support 28. The annular seal support 28 has threaded holes formed in its underside and the previously mentioned bolts 13 are threaded into the holes in order to rigidly secure the seal support 28 to the base plate 11. A centrally located, vertically extending opening 29 is formed through the seal support 28. The upper end portion of passage 29 is widened and it forms a ledge or seat 33 formed on the inner periphery of the passage 29 in order to properly align the seal 39 in the support 28. The blade shaft 21 extends through passage 29. Above the seal 29, a blade 36 (see also FIG. 1*b*) is positioned on the upper end of the blade shaft 21 and secured thereto by a cap nut 37. The conventional lip seal 39 is provided between the bearing 31, the blade shaft 21 and the washer 38 in order to form a fluidtight seal at this juncture.

The vessel 26 is in this instance doublewalled and includes an outer wall 41 and an inner wall 42, the two walls being spaced in order to form a flow passage 43 between them. The two walls 41 and 42 are bowl-shaped and at their lower center portions have aligned openings 44 formed through them which receive the seal support 28, the two walls 41 and 42 being secured to the seal support 28 such as by welding. At their upper ends, the two walls 41 and 42 are flared radially outwardly from the axis of the blade shaft 21 and are pressed tightly together to form a sealed connection in the area indicated by the reference numeral 46. A heat exchange medium is passed through the space 43 between the two walls, an inlet tube 47 and an outlet tube 48 being secured to the outer wall 41 and connected to the space 43 in order to flow the heat exchange medium through space 43.

The lid 27 extends across the upper side of the two walls 41 and 42 and overlies the upper sides of the flared portions 46. To secure the lid 27 tightly to the vessel 26, a ring 51 is positioned on the underside of the flared portions 46 and the periphery of the circular lid 27 extends across the upper side of the flared portion 46. A circular clamp 52 encircles the outer peripheries of the ring 51 and the lid 27, the clamp 52, the ring 51 and the lid 27 having mating bevelled surfaces 53 so that the clamp 52 wedges or cams the lid 27 tightly downwardly toward the member 52 when the parts are assembled. A gasket or annular seal 54 is mounted between the adjacent surfaces of the ring 51 and the lid 27 in order to seal the connection.

Formed within the housing 26 is a toroidal or donut shaped cavity 61 which is formed between the inner wall 42 of the housing 26 and the lid 27. The interior wall surface 63 of the vessel is in the shape of a round bowl and forms the lower half of the toroidal cavity. The upper half of the toroidal cavity is formed by an annular concave recess 64 formed in the underside of the lid 27 above the wall 63, the annular recess 64 being coaxial with the axis of rotation of the blade 36 and with the center of curved surface 63 of the vessel 26. At the outer periphery of the cavity 61, the interior surface of the recess 64 extends downwardly in the area indicated by the numeral 66 and is closely adjacent the upper edge surface 67 of the ends of the blade 36. In addition, the lid 27 dips downwardly along the axis of the toroidal cavity 61 to form a center portion 68, and the center of the blade 36 and the cap nut 37 slope up at the center of the toroid, directly under the portion 68.

The lid 27 has two holes or passages 71 and 72 formed in it. The passage 71 is on the axis of the cavity 61 and extends from the upper surface of the lid 27 and through the portion 68 and opens on the axis of the cavity 61. A tube 73 is fastened to the upper end of the passage 71 by a threaded fitting 74, and a pressure control device 76, which in the present instance is a weight, is positioned on the upper end of the tube 73. A dead-end hole 77 is formed in the weight 76 and the upper end of the tube 73 extends into the hole 77. During the operation of the processor, internal pressure within the cavity 61 may be vented out of the cavity through the tube 73 if the pressure is above the amount required to lift the weight 76 off of the upper end of the tube 73, and the weight 76 thereby maintains pressure within the cavity. The passage 72 is connected to another tube 78 by a fitting 79, and the passage 72 extends to the uppermost portion of the cavity 61. The passage 72 and the tube 78 may be used, for example, for venting air from the cavity 61 when it is filled with a fluid to be processed, and a thermocouple (not shown) may be inserted through the tube 78 and the passage 72 and into the upper surface of the fluid during the processing in order to monitor the temperature of the fluid.

Figure 4:
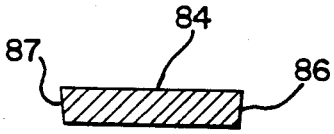
FIG. 4 is a sectional view taken on the line 4—4 of FIG. 1*b*.

The blade 36 includes a central thickened portion 81 which has a vertically extending hole 82 formed through it for the blade shaft 21. The cap nut 37 fits across the upper surface of the portion 81. Extending radially outwardly from the portion 81 are two arms 83 and 84 which curve radially outwardly and upwardly and extend closely adjacent (a clearance of about 0.5 to 1.0 mm is preferred) the interior curved surface 63 of the wall 42 of the vessel. The upper end portions of the blade arms 83 and 84 are substantially parallel with the blade axis, and thus the arms extend over the lower half of the toroidal cavity. As shown in FIG. 1*b*, the sides 86 and 87 of the two arms 83 and 84 also taper such that the blade arms narrow adjacent their outer ends. Assuming that the blade 36 and the shaft 21 rotate in the counterclockwise direction as seen in FIG. 1*b*, the two arms 83 and 84 have leading sides 86 and trailing sides 87. With reference to FIG. 4, the two edges 86 and 87 of each arm are relatively blunt but preferably taper downwardly and toward each other.

Figure 1B:
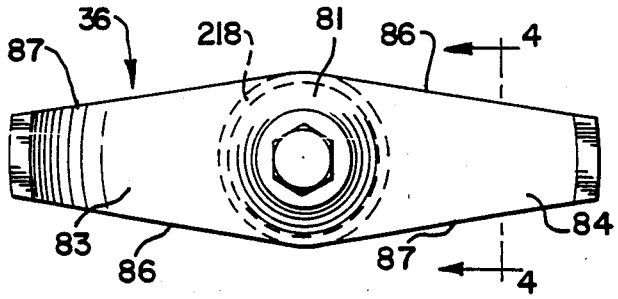
FIG. 1*b* is a plan view of a blade of the processor.

Considering the operation of the processor illustrated in FIG. 1*a*, assume that the composite shaft 20, 21 is coupled to be rotated by a suitable drive motor and that the lid 27 is initially removed from the vessel 26. The cavity 61 is filled with a batch of fluid which is substantially equal in volume to the volume of the cavity 61 with the lid on the vessel. With this batch of fluid in the vessel portion of the cavity, the lid 27 is positioned over the vessel with the annular portion 66 of the lid extending downwardly into the vessel cavity. The clamp 52 is then attached to the adjoining outer peripheral parts of the vessel and the lid, in order to tightly secure the lid to the vessel. As the lid 27 is moved downwardly onto the vessel, air in the upper portion of the concave recess 64 may escape through the passage 72, along with any excess amount of the fluid within the cavity 61. Elimination of the air from the cavity may be assisted by slowly turning the composite drive shaft 20, 21 and the blade 36 in order to eliminate any air pockets in the fluid and remove any air from the cavity. In this manner, air is eliminated from the cavity 61 prior to processing.

Figure 5:
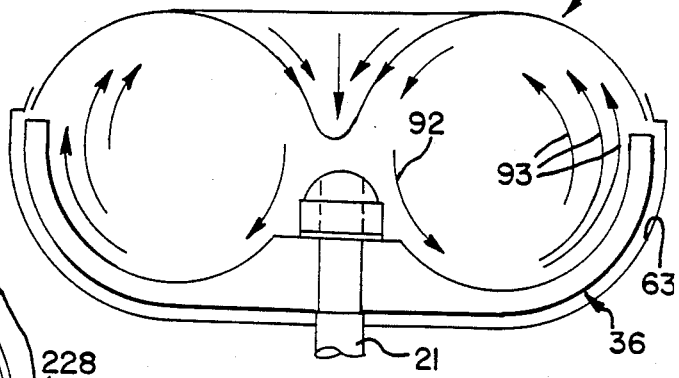
FIG. 5 is a view illustrating the operation of the processor.

To process the fluid, the composite drive shaft 20, 21 and the blade 36 are rapidly rotated, and the high speed rotation of the arms 83 and 84 creates high shear forces within the fluid. Subsonic pulses are formed at the leading edges 86 of the arms and cavitation occurs at the trailing edges 87. The rapid rotation of the arms causes the fluid to assume the shape of a natural toroid 91 or donut as illustrated in FIG. 5. By a natural toroid, it is meant that the fluid naturally assumes the toroidal shape in the absence of the lid 27 on the vessel. In other words, if the lid 27 were removed and the blade rotated at a sufficient speed, the fluid will assume the shape of the toroid 91. The annular concave recess 64 in the underside of the lid 27 is shaped to conform to the surface o the toroid 91, thereby disallowing presence of "dead zones" wherein fluid flow is much less intense.

With reference to FIG. 5, the surface fluid of the toroid 91 flows upwardly and radially inwardly from the outer ends of the blade arms, and the fluid circles along the path indicated by the arrows 92. In addition, the fluid moves in the circumferential direction and follows the direction of movement of the blade, thereby forming a helical path. Further, it is theorized that a number of concentric layers are formed in the fluid (the layers being represented by the concentric arrows 93), and the layers follow similar helical paths. There is also, however, movement of the fluid between the layers so that homogeneity is rapidly produced within the fluid. The movement of the blade through the fluid and the movement of the various fluid layers against each other is so intense that there is a high degree of conversion of mechanical energy to heat.

When the blade is rotated at about 5,000 rpm, the blade causes the fluid to undergo the described rapid toroidal flow and significant cavitation and turbulence are created, particularly in front of the leading edges 86. The flow of the fluid permits rapid heat transfer from the wall 42 and the heat exchange medium. The agitation or high shear force produced by the blade quickly mixes and heats the fluid. The conversion of mechanical energy to heat is estimated by measuring the temperature rise in the fluid above the temperature of the heat exchange medium per unit of time and per unit of mass. The intensity of work input to the fluid by rotating blade 36 is sufficiently high (as reflected by the magnitude of temperature rise due solely to mechanical effects) to prevent the aggregation of, e.g., protein molecules, larger than a particle size of about 1 to 2 microns.

The blade 36 is particularly effective in heating and mixing the fluid. The relatively blunt leading edges 86 of the blade at 5,000 rpm produce subsonic pulses in the fluid, whereas cavitation occurs at the trailing edges 87. The slight downward and inward taper of the sides 86 and 87 (shown in FIG. 4) moves the fluid in front of the blade arms toward the bottom of the cavity and against the wall. This action produces great agitation of the fluid and also effectively eliminates accumulation of product on the cavity wall. The blade produces a natural torus and the chamber or cavity is shaped to match the natural tors during mixing, thereby avoiding dead space in the cavity, preventing caking or buildup of the product in low flow spaces, and promoting uniformity of the mix.

In an instance where the fluid in the cavity is to be prevented from becoming too hot, a cooling medium is flowed through the tubes 47 and 48 and the space 43 in order to restrain the fluid in the cavity 61 from rising beyond a desired temperature. On the other hand, if the fluid is to be heated, a hot medium may be flowed through the space 43. After the fluid has been sufficiently agitated by the blade and the temperature of the fluid is at the desired level, the blade rotation is stopped, the lid 27 is removed, and the batch of the mixed fluid is removed from the cavity 61.

Figure 2:
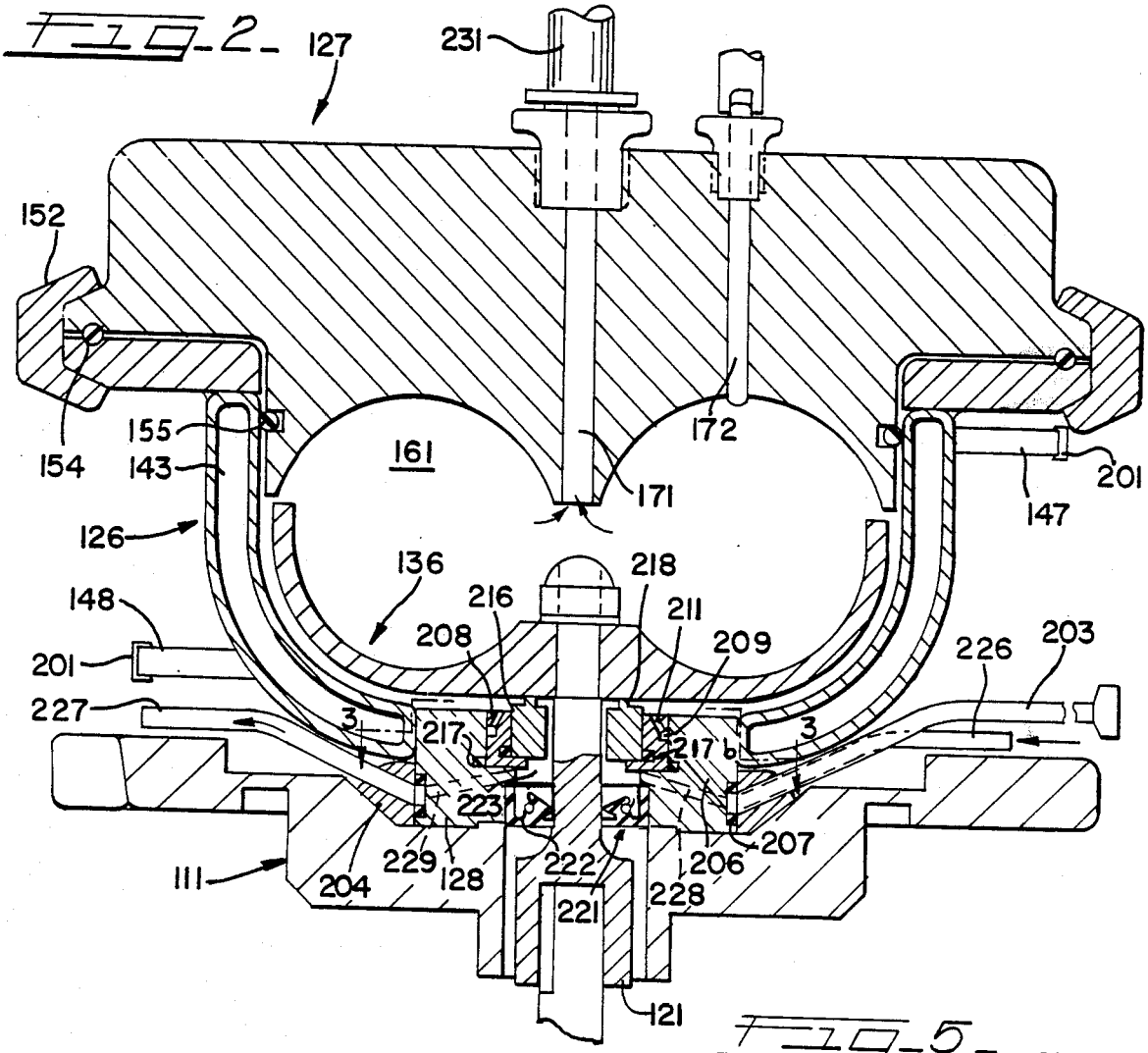
FIG. 2 is a view similar to FIG. 1 but showing a preferred embodiment of the invention, which is designed for continuous flow operation.
Figure 3:
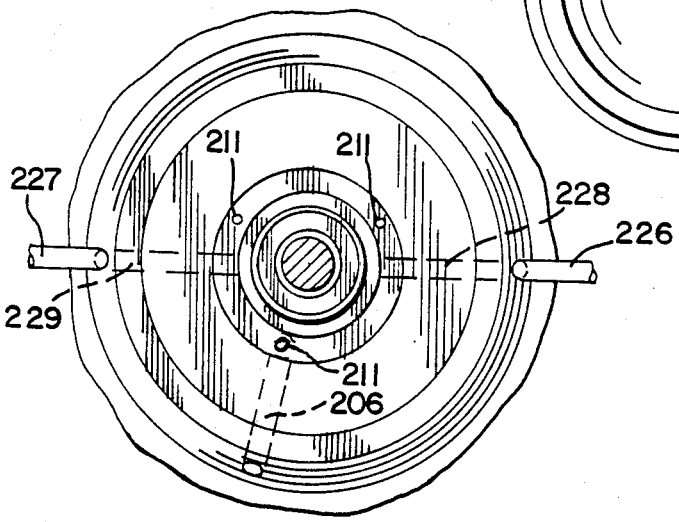
FIG. 3 is a sectional view taken on the line 3—3 of FIG. 2.

FIGS. 2 and 3 illustrate a preferred embodiment of the invention which is designed for a continuous flow operation as contrasted with the batch operation of the embodiment shown in FIG. 1*a*. The embodiments of FIG. 1*a* and FIG. 2 include corresponding parts and the same reference numerals are used in the two figures for corresponding parts, except that the numerical value of 100 is added to the numerals in FIGS. 2 and 3.

With specific reference to FIG. 2, the processor includes a vessel 126 and a lid 127 which are similar to those of FIG. 1*a* except that the lid 127 has a larger vertical thickness. The vessel and the lid in FIG. 2 are fastened together by a clamp 152 with seal 154 and O-ring 155 located between them. The vessel and the lid form a toroidal cavity 161 between them and a blade 136 is mounted within the cavity 161. In this specific example, the vessel 126 also has double walls similar to the vessel of FIG. 1*a* and inlet and outlet tubes 147 and 148 are also provided. However, the tubes 147 and 148 are sealed by plugs 201 in order to form a dead air space 143 between the two walls, this space acting as insulation around the vessel. The lid 127 has the passage 172 formed in it which may be used for a thermocouple sensor, and the passage 171 which, in this instance, forms an outlet for the continuous flow of the fluid product after processing as it leaves the cavity 161.

The vessel 126 is mounted on the base plate 111 by a base 128 which in this embodiment of the invention also includes a passage for the flow of the fluid into the processor cavity. A product inlet tube 203 is connected to a source (not shown) of the fluid product and to an annular seal ring 204 which fits tightly around the outer periphery of the base 128. The inner end of the tube 203 connects with a diagonal passage 206 in the base 128, which is sealed at its outer end by an O-ring 207. The passage 206 angles radially inwardly and upwardly as seen in FIG. 2 to the interior surface of the base 128 and to a spacer bushing 208. A circular recess or groove 209 is formed in the outer surface of the bushing 208 and the passage 206 is in flow communication with the groove 209. Consequently, product flowing into the processor through the tube 203 flows through the passage 206 and into the annular groove 209. A plurality of feed or inlet ports 211 angle upwardly and radially inwardly from the groove 209 and the upper ends of the ports 211 appear on the upper surface of the bushing 208 below the lower surface of the blade 136. Due to the angles of the inlet ports 211, the fluid product entering the cavity first flows radially inwardly and upwardly and then flows radially outwardly and upwardly past the sides of the blade 136.

A mechanical seal 216 is provided to seal the connection between the spacer bushing 208 and the blade 136. The mechanical seal 216 is annular and is sealed to the bushing 208 by O-rings 217 and 217B, and an upwardly projecting seal face 218 on the upper end of the seal 216 engages the underside of the blade 136. With reference to FIG. 1*b*, the seal face 218 is shown in dashed lines and it will be noted that it is entirely within the outer contour of the blade. To obtain a good seal, the underside of the blade 136 in the area of the seal face 218 is preferably lap ground. Another rotary lip seal 221 is provided between the base 128 and the shaft 121 in order to seal this connection. The seal 221 is nonrotatably mounted at its outer periphery on the base 128 and its inner periphery slidingly engages the outer surface of the shaft 121. An annular spring 222 such as a garter spring holds the lip seal tightly against the shaft 121.

A chamber 223 is thus formed between the lip seal 221, the mechanical seal 216, the outer surface of the shaft 121 and the bushing 208. This chamber 223 is flushed by cooling water which enters the processor through a tube 226 and leaves the processor through another tube 227, the two tubes being located at opposite sides of the processor as shown in FIG. 3. The two tubes 226 and 227 are also mounted on the seal ring 204 and extend radially through the ring 204. Flow passages 228 and 229 are formed through the base 128, the inner ends of the two passages connecting with opposite sides of the chamber 223. The outer ends of the passages 228 and 229 respectively connect with the tubes 226 and 227, and O-rings are provided around these connections. Consequently, during operation of the processor, coolant water flows into the processor through the tube 226, into the chamber 223 and around the internal surfaces in the area where the mechanical seal 216 meets the lower surface of the blade 136, and then out of the chamber through the tube 227.

During the operation of the processor, the lid 127 is fastened to the vessel 126, the blade 136 is rotated within the cavity 161, and the coolant water is flowed through the chamber 223. The product mix is then introduced into the cavity 161 by being flowed through the inlet tube 203, through the passage 206 and the inlet ports 211, and into the cavity 161 from the underside of the rotating blade 136. The fluid product fills the cavity 161 and air initially filling the cavity is flushed by fluid flow through the tube. The fluid assumes its natural toroidal shape within the cavity 161 as previously described and the walls of the vessel 126 and the lid 127 conform to the shape of the natural toroid. The product within the cavity is held under pressure because pressure is required in the tube 203 in order to force the fluid product through the cavity and out of the passage 171. The outlet tube 231 connected to the passage 171 may contain a restriction or valve in order to form a back pressure and thereby increase the pressure within the cavity 161.

The described mixing and heating of the fluid in the cavity 161 is similar to that in the cavity 61. The fluid entering the cavity flows directly into a high shear area below the blade. Further, the upward and inward angle of the ports 211 causes the incoming fluid to form a turbulent flow and wash against the seal 216, and thereby prevent any buildup or caking of the fluid in this area. Further, the inward flow and proximity to the center ensures that all of the fluid flows under the blade and that some of the fluid will not be shunted out at the sides of the arms immediately after leaving the ports 211. The coolant flow within the chamber 223 prevents the bearing 216 and the blade from overheating and burning the fluid product being processed. The port 211 opposite inlet 206 is preferably slightly enlarged to provide uniform flow through the three ports.

It will be apparent from the foregoing that a novel and useful processor has been provided. The processor is particularly effective where the blade simultaneously mixes, heats and reduces the particle size of the fluid, giving rise to homogeneous smooth products. Dead space within the mixing chamber or cavity is avoided as are areas where caking or burning of the product may occur. Accurate heat control of the fluid is also possible and the processor may be adapted for either batch or continuous operation.

While a blade having two arms has been described, it should be understood that the blade could have three or four arms, for example. Further, the arms could be longer and extend upwardly into the recess of the lid. Numerous other modifications and variations in design of apparatus according to the present invention are expected to occur to those of ordinary skill in the art upon consideration of the foregoing description of illustrative embodiments thereof. Consequently, only such limitations as appear in the appended claims should be placed upon the invention.

What is claimed is:

1. A fluid processing device comprising:

means for generating a toroidal flow in a fluid to be processed;

container means enclosing said toroidal flow generating means for enclosing fluid undergoing toroidal flow, the interior surface conformation of said container means being substantially defined by the external conformation of a fluid enclosed therein undergoing toroidal flow.

2. A processing device according to claim 1 wherein said toroidal flow generating means comprises a blade mounted for axial rotation within said container means.

3. A processing device according to claim 2 wherein said container means comprises a vessel and a vessel lid, said vessel having a curved inner wall forming a bowl shaped cavity and said vessel lid having a curved inner wall in the form of the upper portion of a toroid.

4. A processing device according to claim 3 wherein said blade comprises at least two arms which extend radially outwardly from the blade's axis of rotation and smoothly curve and extend closely adjacent the curved inner walls of said vessel.

5. A processing device according to claim 4 wherein the arms of said blade have leading sides which are forward in the direction of rotation of said blade during rotation, said leading sides being substantially blunt and extending closely adjacent said inner walls.

6. A processing device according to claim 5, wherein portions of said arms extend substantially parallel with the blade's axis of rotation.

7. A processing device according to claim 4, wherein said leading sides of said arms slant outwardly and away from said axis.

8. A fluid processing device comprising:

(a) a vessel having curved inner walls forming a bowl shaped cavity;

(b) a vessel lid fastened to said vessel and enclosing said cavity, said lid having a concave recess formed therein, said cavity and said recess combining to form a mixing chamber whose interior conformation substantially assumes the shape of the exterior surface conformation of a toroid having a toroidal axis;

(c) a blade mounted within said chamber for rotation on an axis, said axis of rotation being coincident with said toroidal axis, said blade having at least two arms which extend radially outwardly from said axis and smoothly curve and extend closely adjacent said vessel inner walls, said arms being curved similarly to the curve of said walls;

(d) during operation with a fluid in said cavity, said rotating blade cooperating with said inner walls and causing said fluid to assume the shape of a toroid which conforms to the shape and size of said chamber.

9. A processing device according to claim 8, wherein said arms of said blade have leading sides which are forward in the direction of rotation, and said leading sides are relatively blunt.

10. A processing device according to claim 8, wherein said arms have end portions which extend substantially parallel with said axis of rotation.

11. A processing device according to claim 8, wherein said vessel has fluid flow passages formed therein leading to inlet ports for flowing a fluid into said chamber between said blade and said inner walls of said vessel.

12. A fluid processing device comprising a housing having an enclosed mixing chamber formed therein, a blade positioned in said chamber and rotatably mounted on said housing, said blade being adjacent an inner surface of said chamber, said chamber and said blade having matching peripheries and said chamber being substantially symmetrical about the axis of rotation of said blade, rotation of said blade with a fluid in said chamber causing the fluid to assume a toroidal shape, and said chamber being configured to substantially enclose said toroidal shape.

13. A processor according to claim 12, wherein said housing has a fluid inlet passage and a fluid outlet passage formed therein.

14. A processor according to claim 13, wherein said outlet passage is substantially on said axis of rotation.

15. A processor according to claim 13, wherein said inlet passage is between said blade and a an adjacent inner surface of said chamber.

16. A fluid processing device comprising a housing having an enclosed mixing chamber formed therein, said chamber enclosing a space defined by the external conformation of a fluid enclosed therein undergoing toroidal flow having a toroidal axis, a blade rotatably mounted in said chamber and having an axis of rotation which is substantially coincident with said toroidal axis, a fluid outlet formed in said housing for removing fluid from said chamber at substantially said toroidal axis, and a fluid outlet formed in said housing.

17. A processor according to claim 16, wherein said fluid inlet is located between said blade and an adjacent interior surface of said chamber.

18. A processor according to claim 16, wherein said fluid inlet comprises a plurality of openings spaced around said axis.

19. A processor according to claim 16 further including a bearing on said housing for rotatably mounting said blade, and further including coolant flow passages in said housing for cooling said bearing.

* * * * *

UNITED STATES PATENT AND TRADEMARK OFFICE

CERTIFICATE OF CORRECTION

PATENT NO. : 4,828,396

DATED : May 9, 1989

INVENTOR(S) : Singer, et al.

It is certified that error appears in the above-identified patent and that said Letters Patent is hereby corrected as shown below:

Column 2, line 35, change "bunt" to --blunt--;

column 5, line 53, change "o" to --of--;

column 6, line 30, change "tors" to --torus--;

column 10, line 26, delete "a";

column 10, line 37, change "outlet" to --inlet--.

Signed and Sealed this

Twenty-fourth Day of April, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,828,396

DATED : May 9, 1989

INVENTOR(S) : Singer, et al.

It is certified that error appears in the above-identified patent and that said Letters Patent is hereby corrected as shown below:

Figure 1, change item "7" to item --71--.

Signed and Sealed this

Twelfth Day of June, 1990

*Attest:*

HARRY F. MANBECK, JR.

*Attesting Officer*

*Commissioner of Patents and Trademarks*